US009721688B2

(12) United States Patent
Nilles

(10) Patent No.: US 9,721,688 B2
(45) Date of Patent: Aug. 1, 2017

(54) LIFT-BASED UP-ENDER AND METHODS USING SAME TO MANIPULATE A SHIPPING CONTAINER CONTAINING UNIRRADIATED NUCLEAR FUEL

(71) Applicant: BWXT mPower, Inc., Charlotte, VA (US)

(72) Inventor: Michael J. Nilles, Lynchburg, VA (US)

(73) Assignee: BWXT mPower, Inc., Charlotte, NC (US)

( * ) Notice: Subject to any disclaimer, the term of this patent is extended or adjusted under 35 U.S.C. 154(b) by 308 days.

(21) Appl. No.: 14/179,269

(22) Filed: Feb. 12, 2014

(65) Prior Publication Data

US 2015/0228366 A1 Aug. 13, 2015

(51) Int. Cl.

| | |
|---|---|
| ***G21F 5/14*** | (2006.01) |
| ***B66C 1/12*** | (2006.01) |
| ***B66C 1/62*** | (2006.01) |
| ***B66C 13/08*** | (2006.01) |

(52) U.S. Cl.

CPC ..... *G21F 5/14* (2013.01); *B66C 1/12* (2013.01); *B66C 1/62* (2013.01); *B66C 13/08* (2013.01)

(58) Field of Classification Search

CPC ..... G21F 5/14
USPC ..... 376/272
See application file for complete search history.

(56) References Cited

U.S. PATENT DOCUMENTS

| | | | | |
|---|---|---|---|---|
| 5,126,098 | A | 6/1992 | Sparrow | |
| 5,661,768 | A * | 8/1997 | Gilligan, III | G21C 19/32 376/261 |
| 5,970,109 | A | 10/1999 | Meier-Hynek et al. | |
| 6,266,386 | B1 | 7/2001 | Patel et al. | |
| 2003/0015541 | A1 | 1/2003 | Mingot et al. | |
| 2007/0241001 | A1 | 10/2007 | Ales et al. | |
| 2012/0328408 | A1 * | 12/2012 | Sorensen | B66C 23/185 414/816 |
| 2014/0224705 | A1 | 8/2014 | Minor et al. | |

FOREIGN PATENT DOCUMENTS

| | | | |
|---|---|---|---|
| WO | 2011088832 | A1 | 7/2011 |

OTHER PUBLICATIONS

International Search Report and Written Opinion dated Oct. 16, 2015 for PCT/US15/14154.

* cited by examiner

*Primary Examiner* — Jack W Keith
*Assistant Examiner* — Lily C Garner
(74) *Attorney, Agent, or Firm* — Nelson Mullins Riley & Scarborough, LLP

(57) ABSTRACT

A shipping container containing an unirradiated nuclear fuel assembly is lifted off the ground by operating a crane to raise a lifting tool comprising a winch. The lifting tool is connected with the shipping container by a rigging line connecting with the shipping container at a lifting point located on the shipping container between the top and bottom of the shipping container, and by winch cabling connecting with the shipping container at the top of the shipping container. The shipping container is reoriented by operating the winch to adjust the length of the winch cabling so as to rotate the shipping container about the lifting point. Shortening the winch cabling rotates the shipping container about the lifting point from a horizontal orientation to a vertical orientation, while lengthening the winch cabling rotates the shipping container about the lifting point from the vertical orientation to the horizontal orientation.

25 Claims, 5 Drawing Sheets

LIFT-BASED UP-ENDER AND METHODS USING SAME TO MANIPULATE A SHIPPING CONTAINER CONTAINING UNIRRADIATED NUCLEAR FUEL

This invention was made with Government support under Contract No. DE-0000583 awarded by the Department of Energy. The Government has certain rights in this invention.

BACKGROUND

The following relates to the nuclear reactor fuel assembly packaging and transportation arts, to shipping containers for unirradiated nuclear fuel assemblies, to apparatus for manipulating such shipping containers, to shipping and handling methods utilizing same, and to related arts.

Unirradiated nuclear fuel assemblies for light water nuclear reactors typically comprise $^{235}U$ enriched fuel pellets, and in a typical configuration comprise an array of parallel fuel rods each comprising a hollow cladding inside of which are disposed $^{235}U$ enriched fuel pellets. The $^{235}U$ enrichment of the fuel pellets is typically less than 5% for commercial nuclear power reactor fuel.

Transportation of unirradiated nuclear fuel assemblies is accomplished using shipping containers that meet appropriate nuclear regulatory rules, e.g. Nuclear Regulatory Commission (NRC) rules in the United States. Under NRC rules, the shipping containers are designed to preclude the release of radioactive material to the environment and to prevent nuclear criticality from occurring in the event of postulated accidents. Furthermore, the shipping containers are designed to protect the unirradiated fuel from damage during shipment.

Existing nuclear fuel shipping containers are typically "clamshell" designs that are rectangular or cylindrical in shape and consist of a lower shell, one or more internal "strongbacks" that support the fuel assemblies, and a removable top shell that encloses the fuel assemblies. A flanged joint between the top and bottom shells allow the container to be opened and closed by bolted or pinned connections along the periphery of the container. A fuel assembly is generally loaded into the shipping container by removing the top shell from the container and lifting the empty lower shell to a vertical position. The fuel assembly is positioned vertically when not supported by a strongback. The vertical fuel assembly is lifted with a crane and then moved laterally (i.e. sideways while remaining suspended upright by the crane) into the upright lower shell of the clamshell container until it is positioned against the strongback of the container. In some designs, several clamps along the length of the fuel assembly may be incorporated to secure the fuel assembly to the strongback. Some designs utilize hinged doors that cover the fuel and are clamped in place to secure the fuel assembly. After the fuel assembly is secured, the shipping container is placed in a horizontal position and the top shell is installed. The shipping container is shipped in the horizontal position. At the nuclear reactor site, the process is reversed, i.e. the top shell is removed, the lower shell with the fuel assembly still loaded on the strongback is up-ended from the horizontal position to the vertical position, and the fuel assembly is unclamped from the strongback and lifted out using a crane and loaded into the nuclear reactor. See, e.g. Sappey, U.S. Pat. No. 5,263,064; Sappey, U.S. Pat. No. 5,263,063.

The clamps and doors used in clamshell type shipping containers have certain disadvantages. For example, the hinged connections and clamping mechanisms can generate metal shavings that can become trapped inside the fuel assemblies and lead to fretting failure of the fuel rods. The mechanical parts such as bolts, nuts, and washers, can become detached and may lead to fuel rod failure if the loose parts become trapped inside the fuel assembly. The securing mechanisms entail certain adjustments to avoid applying excessive forces on the fuel assemblies, and have the potential to become loose during transport. These securing mechanisms also adds time to the processes of loading and unloading the fuel assemblies from the containers. Moreover, the clamshell container can hold only one or two fuel assemblies, such that the complete set of loading and unloading operations may need repeated for each fuel assembly that is transported from the factory to the nuclear reactor site.

The operation of moving the shipping container (or lower shell) with loaded fuel between the horizontal and vertical positions is typically performed using a dedicated piece of equipment, which is referred to in the art as an "up-ender" (even when used to move the loaded shipping container from the vertical position to the horizontal position). Existing up-enders are typically complex dedicated pieces of equipment that have numerous components and that occupy substantial storage space when not in use. See, e.g. Ales et al., U.S. Pub. No. 2007/0241001 A1.

BRIEF SUMMARY

In one disclosed aspect, a method is disclosed, which is performed on a shipping container having a defined top and bottom and including a lifting connection feature disposed on the shipping container between the top and bottom of the shipping container and a top connection feature disposed at the top of the shipping container. The method is performed using an up-ender comprising a lifting anchor element with a rigging line extending downward and connecting with the lifting connection feature of the shipping container and a winch connected with the lifting anchor element and including winch cabling extending downward and connecting with the top connection feature of the shipping container. The method comprises: (1) raising the lifting anchor element to draw the rigging line taut and operating the winch to draw the winch cabling taut; (2) further raising the lifting anchor element to lift the lifting anchor element and the winch connected with the lifting anchor element upward whereby the shipping container is lifted off the ground by the taut rigging line and the taut winch cabling; and (3) reorienting the shipping container by one of (i) operating the winch to shorten the winch cabling so as to rotate the shipping container about the lifting connection feature from a horizontal orientation to a vertical orientation and (ii) operating the winch to lengthen the winch cabling so as to rotate the shipping container about the lifting connection feature from a vertical orientation to a horizontal orientation.

In another disclosed aspect, an apparatus comprises a shipping container configured to contain at least one unirradiated nuclear fuel assembly, and an up-ender. The shipping container has a defined top and bottom and includes: a lifting connection feature disposed on the shipping container between the top and bottom of the shipping container; and a top connection feature disposed at the top of the shipping container. The up-ender comprises: a lifting anchor element configured to be raised or lowered by a crane or hoist and including a rigging line extending downward to connect with the lifting connection feature of the shipping container; and a winch including winch cabling extending downward to connect with the top connection feature of the shipping container wherein the length of the winch cabling is adjustable by operation of the winch. The winch is configured to move with the lifting anchor element as the lifting anchor element is raised or lowered by a crane or hoist at least when the winch cabling is drawn taut.

In another disclosed aspect, a method comprises: lifting a shipping container off the ground by operating a crane to raise a lifting tool comprising a winch, the lifting tool being connected with the shipping container by (i) a rigging line connecting with the shipping container at a lifting point located on the shipping container between the top and bottom of the shipping container and (ii) winch cabling connecting with the shipping container at the top of the shipping container; and reorienting the shipping container by operating the winch to adjust the length of the winch cabling so as to rotate the shipping container about the lifting point. The reorienting may comprise operating the winch to shorten the winch cabling by an amount effective to rotate the shipping container about the lifting point from a horizontal orientation to a vertical orientation, and/or the reorienting may comprise operating the winch to lengthen the winch cabling by an amount effective to rotate the shipping container about the lifting point from a vertical orientation to a horizontal orientation. The method may further include loading an unirradiated nuclear fuel assembly comprising $^{235}U$ enriched fuel into the shipping container.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION OF THE PREFERRED EMBODIMENTS

Figure 2:
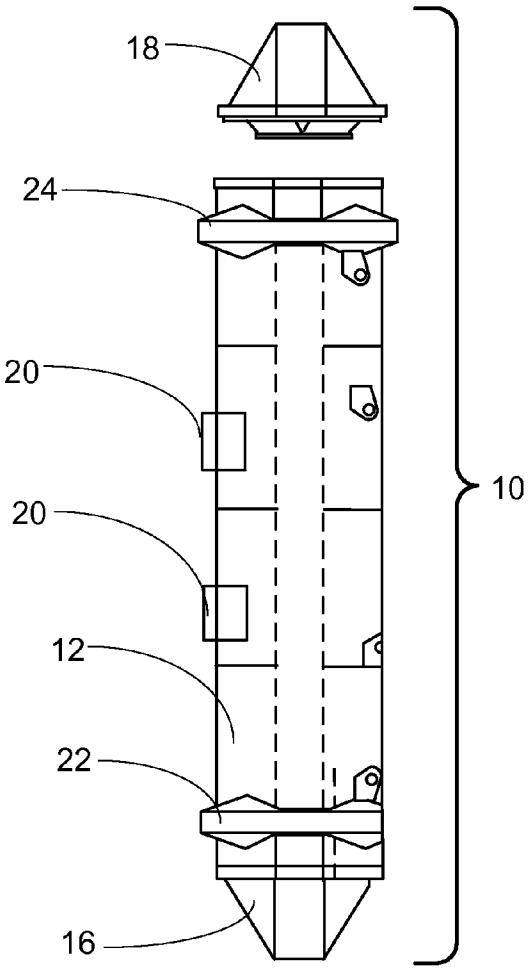
FIG. 2 illustrates a side view of the shipping container of FIG. 1 with the top end cap lifted off in preparation for loading or unloading nuclear fuel assemblies.

A more complete understanding of the processes and apparatuses disclosed herein can be obtained by reference to the accompanying drawings. These figures are merely schematic representations and are not intended to indicate relative size and dimensions of the assemblies or components thereof.

Although specific terms are used in the following description for the sake of clarity, these terms are intended to refer only to the particular structure of the embodiments selected for illustration in the drawings, and are not intended to define or limit the scope of the disclosure.

In some illustrative embodiments, a shipping container comprises a plurality of fuel compartments, each fuel compartment comprising a first side and a second side; a chamber wall enclosing a portion of the fuel compartment; a shock absorbing material peripherally surrounding the chamber wall, and an outer shell peripherally surrounding shock absorbing material.

In some illustrative embodiments, a method for loading a fuel assembly in a shipping container comprises: positioning a shipping container vertically in a loading stand; disassembling a container top removably assembled to a outer shell at a first end of the shipping container; loading a fuel assembly vertically at a first end of the shipping container into the a fuel assembly chamber; and reassembling the container top to the outer shell at a first end of the shipping container.

Figure 4:
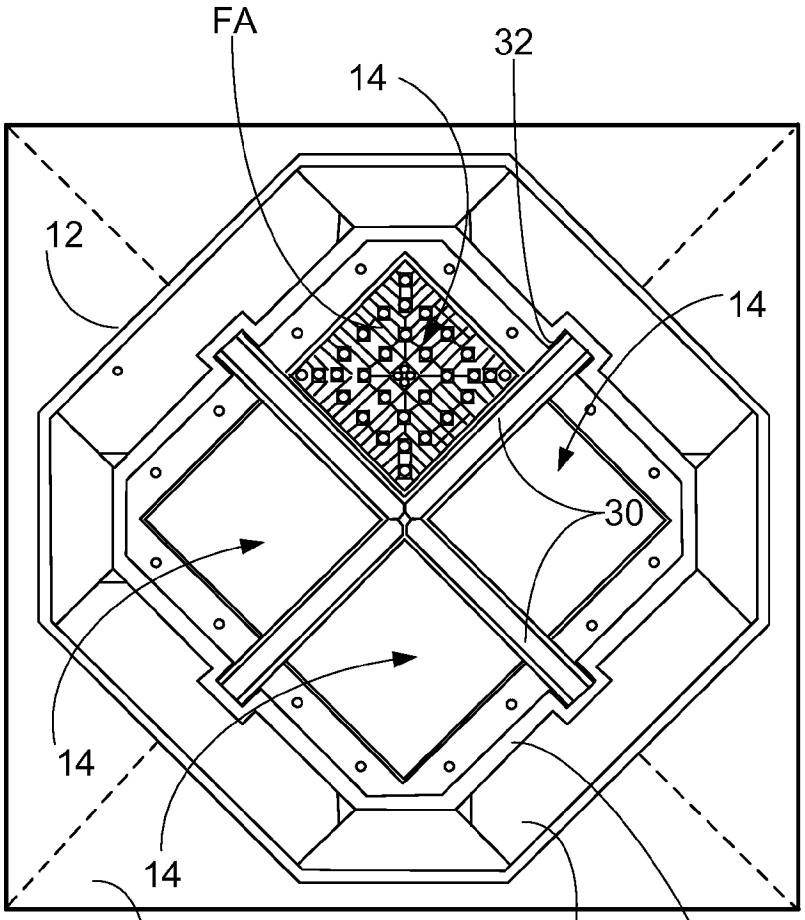
FIGS. 3 and 4 illustrate perspective and top-end views, respectively, of the shipping container of FIGS. 1 and 2 with the top end-cap removed and with a fuel assembly loaded into one of the four fuel assembly compartments and the remaining three fuel assembly compartments being empty.
Figure 3:
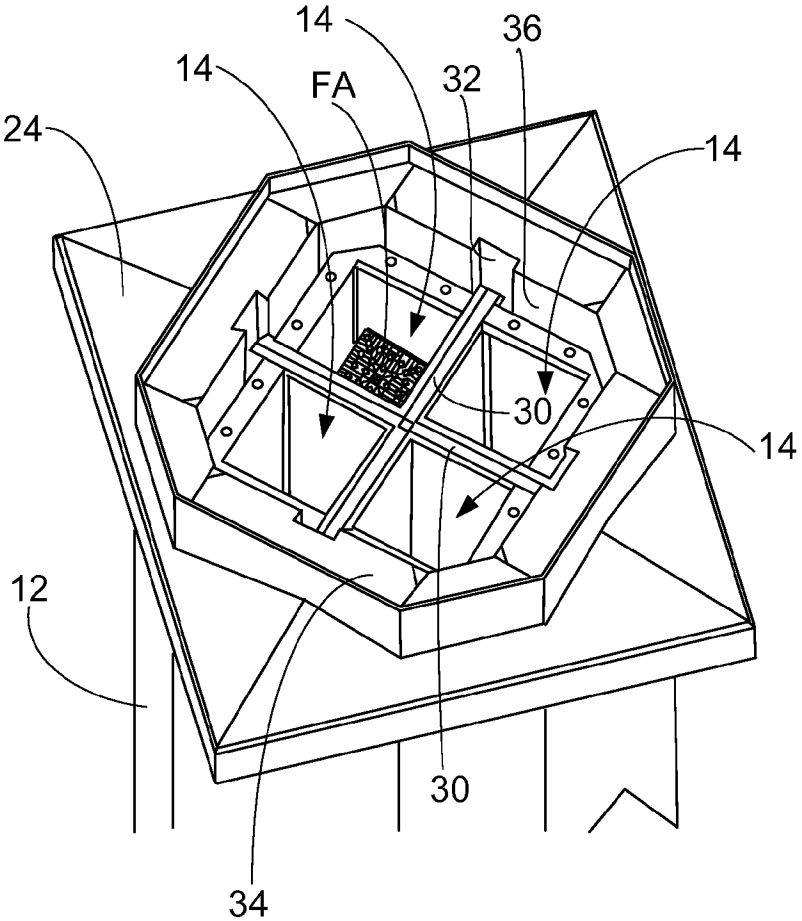

With reference to FIGS. 1-5, an illustrative shipping container 10 comprises an outer shell 12 surrounding and containing one or more (four, in the illustrative example) fuel assembly compartments or chambers 14 as shown in the perspective and top-end views of respective FIGS. 3 and 4. The shell 12 is cylindrical or tubular in shape. The terms "tubular" and "cylindrical" are used interchangeably herein to indicate that the shell 12 is an elongate hollow element. The tubular or cylindrical shell 12 is not limited to any particular cross-sectional shape, e.g. the tubular or cylindrical shell 12 can have various cross-sectional shapes including but not limited to a circular cross-section, a hexagonal cross-section, a square cross-section, a hexagonal cross-section, or so forth. The tubular or cylindrical shell 12 can also be constructed to have different cross-sectional shapes for the outside of the shell 12 versus the inner volume of the shell 12.

Each fuel assembly compartment or chamber 14 is sized and shaped to receive a fuel assembly. The top-end views of FIGS. 3 and 4 show one chamber containing a loaded fuel assembly FA, while the remaining three chambers are empty. While the illustrative shipping container 10 includes four fuel assembly chambers 14, more generally the number of fuel assembly chambers can be one, two, three, four, five, six, or more. The illustrative fuel assembly chambers 14 have square cross-sections coinciding with or slightly larger than the square cross-section of the illustrative fuel assembly FA; more generally, each chamber has a cross-section comporting with the cross-section of the fuel assembly, e.g. if the fuel assemblies have hexagonal cross-sections then the chambers preferably have hexagonal cross-sections. In one contemplated embodiment, the fuel assembly compartments or chambers 14 are sized to receive fuel assemblies with square cross-sections in the range of about 8 inches×8 inches to about 9 inches×9 inches.

Figure 1:
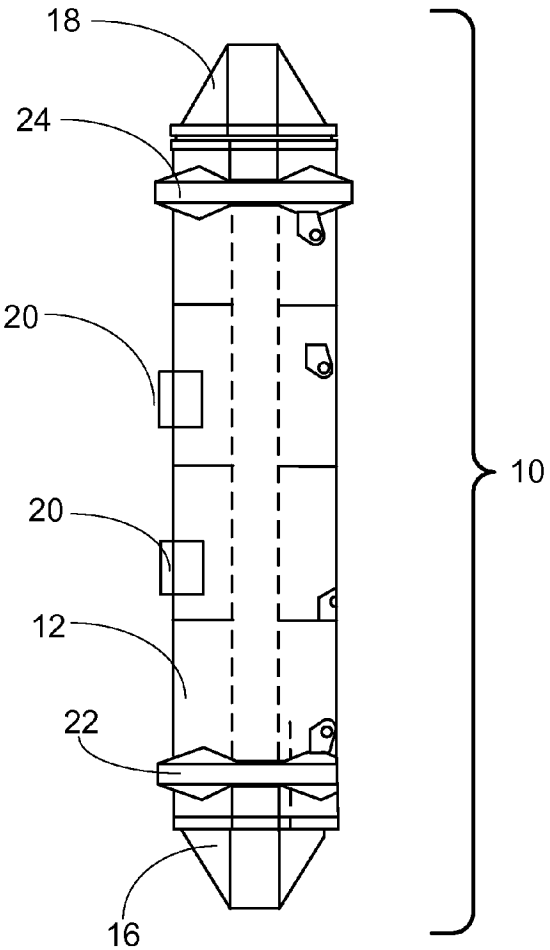
FIG. 1 illustrates a side view of a shipping container in its upright or vertical position for transporting a plurality of unirradiated nuclear fuel assemblies
Figure 5:
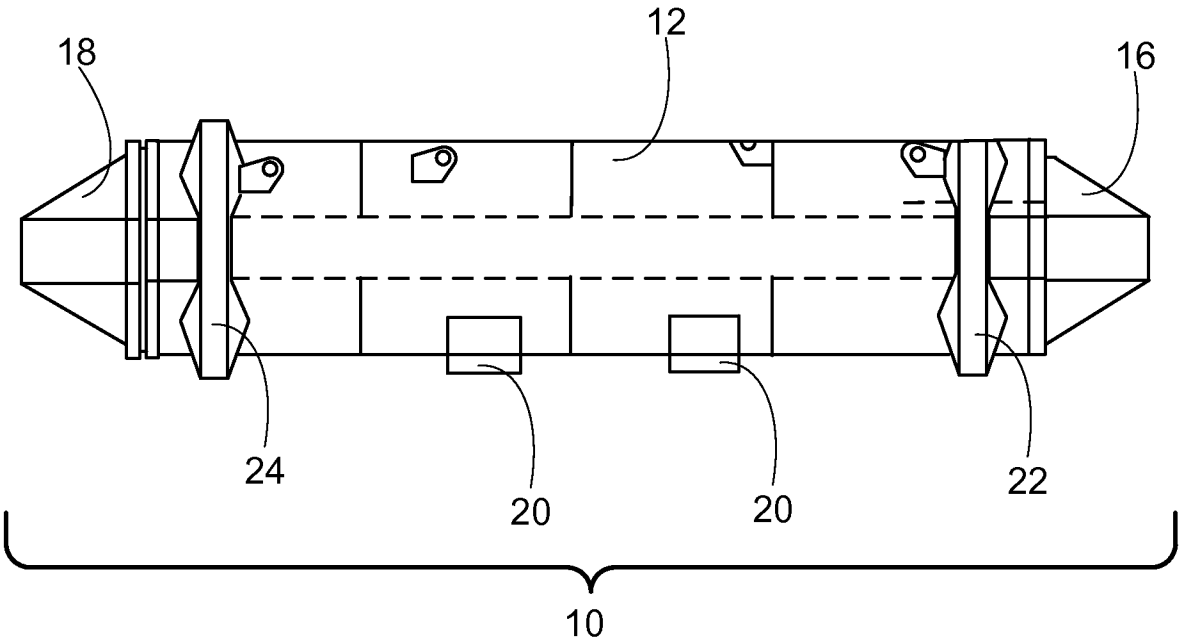
FIG. 5 illustrates a side view of the shipping container of FIGS. 1-4 in its horizontal shipping position.

As seen in FIGS. 1 and 5, the shipping container 10 further includes a lower or bottom end-cap 16 and an upper or top end-cap 18. The shipping container is designed for top-loading, and FIG. 1 shows the shipping container 10 oriented vertically (that is, with the tube or cylinder axis of the tubular or cylindrical shell 12 oriented parallel with the direction of gravity and transverse to a level floor) for loading with the top end-cap 18 located at the highest point and the bottom end-cap 16 located at the lowest point. FIG. 2 shows the shipping container 10 in its vertical position for loading with the upper end-cap 18 removed to allow access to the fuel assembly chambers 14 from above, as seen in the top end views of FIGS. 3 and 4 in which the top end-cap has been removed. After four fuel assemblies are loaded into the four chambers 14 (note however it is contemplated to leave one or more of the chambers 14 empty, that is, it is not necessary to load all four chambers for safe transport), the top end-cap 18 is replaced, and the shipping container 10 is moved to a horizontal position (that is, with the tube or cylinder axis of the tubular or cylindrical shell 12 oriented transverse to the direction of gravity and parallel with a level floor) as shown in FIG. 5 for transport. In the horizontal position of FIG. 5, the two end-caps 16, 18 are at (approximately) the same level or height. The illustrative shell 12 includes forklift engagement features 20 via which a forklift or other machinery can engage, lift, and manipulate the shipping container 10 while in its horizontal position. The illustrative shell 12 also includes lower and upper support features or flanges 22, 24 on which the shipping container 10 rests when on a flat floor or other flat surface. Optionally, the support features or flanges 22, 24 may also constitute securing flanges via which the respective end-caps 16, 18 are secured. (The forklift engagement features 20 may provide additional or alternative support, or alternatively the forklift engagement features 20 may protrude outward less than the support features or flanges 22, 24 such that the shipping container 10 in its horizontal position is supported only by the flanges 22, 24).

In FIGS. 1, 2, and 5, the two end-caps 16, 18 are visually the same. In some embodiments, the two end-caps 16, 18 are actually structurally identical, and either end can be chosen as the "top" for loading. In other embodiments, the bottom end-cap 16 is structurally distinct from the top end-cap 18, for example by including support foam and/or other support element(s) to support the weight of the loaded fuel assembly FA when the shipping container 10 is in the upright or vertical position shown in FIGS. 1 and 2. Regardless of whether the bottom end is structurally distinct or structurally the same as the top end, it is generally appropriate to have some designation of the upper end, e.g. a "THIS END UP" marking to denote the upper end of the shell 12, since the fuel assemblies typically have defined distinct upper and lower ends. Since the lower end-cap 16 is not removed for the top-loading of the fuel assemblies, it is contemplated for the lower end-cap 16 to be permanently secured to the lower end of the shell 12, for example by welding, or for the lower end-cap 16 to be an integral part of the outer-shell 12, e.g. the shell 12 and the lower end-cap 16 may be a continuous single-piece element. On the other hand, the upper end-cap 18 is removed for the top-loading. In some embodiments the upper end-cap 18 is secured to the upper end of the shell 12 by bolts or other removable fasteners engaging the upper end of the shell 12 and/or the upper support feature or flange 24. The upper end-cap 18 may also be welded to the upper end of the shell 12, but in this case the welds should be breakable by a suitable mechanism, e.g., by using a pry bar. Conversely, while the lower end-cap 16 is not removed for loading or unloading fuel, it is contemplated for the lower end-cap 16 to be secured by bolts or other removable fasteners. The ability to remove the lower end-cap 16 can be advantageous for performing inspection and cleaning of the fuel assembly chambers 14.

Because the shipping container 10 is top-loaded, there is no need for the shell 12 to be constructed as a clam-shell. In some embodiments, the shell 12 is a single-piece tubular or cylindrical element (where the terms "tubular" and "cylindrical" do not require a circular cross-section), e.g. formed by extrusion, casting, forging, or so forth. A continuous single-piece tubular or cylindrical outer-shell has advantages in terms of providing a high level of mechanical strength. However, it is also contemplated to construct the shell 12 as two or more pieces that are welded together or otherwise joined, optionally with a strap banding the pieces together. In such embodiments, the welding, strapping or other joinder can be a permanent joinder (as opposed to being separable to open the shipping container as is the case in conventional clamshell shipping containers), although a separable joiner could also be used, e.g. to facilitate inspection and cleaning of the fuel assembly chambers 14.

With particular reference to FIGS. 3 and 4, each fuel assembly chamber 14 is square in cross section (or otherwise conforms with the cross-sectional shape of the fuel assembly, e.g. may be hexagonal in order to support fuel assemblies with hexagonal cross-sections) and is commensurate with or slightly larger than the space envelope of the fuel assembly FA, so that the fuel assembly FA can be inserted into the fuel assembly chamber 14 without excessive drag. In the illustrative embodiment, the horizontal support elements 20, 22, 24 are oriented respective to the illustrative square fuel assembly chambers 14 such that each fuel assembly FA is oriented with its sides at 45° angles to the supporting floor (or, equivalently, at 45° angles to the direction of gravity). This provides distributed support for each fuel assembly FA along two of the four sides of the illustrative square fuel assembly FA. In addition to providing extended support, this diagonal orientation suppresses lateral movement of the fuel assembly FA in the fuel assembly chamber 14.

With particular reference to FIGS. 3 and 4, the fuel assembly compartments or chambers 14 are defined inside the shell 12 by a divider component 30 that extends most or all of the length of the interior space of the shell 12 and has a cross-sectional shape that, together with the shell 12, defines the cross-sections of the fuel assembly chambers 14. For the illustrative shipping container 10 having four fuel assembly chambers 14, the divider component 30 suitably has a cross-shaped cross-section with the ends of the cross secured to the inner walls of the shell 12, as seen in FIGS. 3 and 4. The divider component 30, along with the inner walls of the shell 12, defines the structural walls of the fuel assembly chambers 14. It will be appreciated that for embodiments in which the shipping container is designed or configured to contain only a single fuel assembly, the divider component may be omitted entirely such that there is a single fuel assembly compartment or chamber defined inside the shell 12. The divider component 30 may be manufactured as a single-piece, e.g. a single-piece cast element, or may be manufactured as two or more planar pieces that are welded together and to the inner walls of the shell 12. In the illustrative embodiment, the inner wall of the shell 12 includes axially oriented grooves 32 (that is, grooves that run parallel with the tube or cylinder axis of the tubular or cylindrical shell 12). These axially oriented grooves 32 receive the cross ends of the cross-shaped (in the sense of having a cross-shaped cross-section) divider component 30. The optional grooves 32 provide convenient alignment for the divider component 30. In a suitable assembly approach, the divider component 30 is top-loaded into the shell 12 by fitting the cross ends into the grooves 32 and sliding the divider component 30 into the shell 12. If the grooves 32 are provided then it is contemplated to rely entirely on the fitting between the grooves 32 and the cross ends of the divider component 30 (along with the end-caps 16, 18) to secure the divider component 30 in place inside the shell 12. Alternatively, tack welding, bolts or other fasteners, or other additional securing mechanism(s) may be employed.

An advantage of the shipping container 10 is that the fuel assembly chambers 14 are designed to provide support for the loaded fuel assemblies FA without the use of straps or a dedicated strongback. Toward this end, the shell 12 and the divider component 30 defining the structural walls of each fuel assembly chamber 14 suitably comprise stainless steel, an aluminum alloy, or another suitably strong material, and the inside of the shell 12 is suitably lined with compressible elastomeric material to protect the fuel assembly FA from damage during installation and shipping. In the illustrative embodiment of FIGS. 3 and 4, the elastomeric material includes a relatively harder and relatively thicker structural shock absorbing foam 34 lined on the inside with a relatively softer and relatively thinner shock absorbing foam 36. It is also contemplated to employ only a single layer of elastomeric material, or to employ three or more layers with different thicknesses, elastomeric and/or structural characteristics. The foam or other elastomeric material 34, 36 is preferably sized such that it is compressed slightly as the fuel assembly is loaded into the chamber, thus preventing excessive movement of the fuel during transport. The thickness(es) and elastomeric characteristics of the elastomeric material 34, 36 are readily optimized to provide sufficient cushioning and to suppress movement of the fuel during transport while also not producing excessive drag when loading and unloading fuel assemblies. In some embodiments the elastomeric material 34, 36 is a consumable element that is replaced each time the shipping container 10 is used for a fuel shipment. Optionally, a protective sheet of thin plastic material (not shown) covers each side of the fuel assembly chamber 14 to prevent foam particulates from contacting the loaded fuel assembly. In one embodiment, the protective sheet of plastic is further lined with a thin foam backing and the thin foam backing compresses slightly when the shipping container 10 is loaded with fuel.

The fuel assembly chambers 14 are also designed to prevent nuclear criticality from occurring in the event of postulated accidents. Toward this end, the divider component 30 and the shell 12 comprise a neutron moderator material (e.g. nylon-6) and/or a neutron absorbing material (e.g. borated aluminum). The neutron moderator and/or neutron absorber materials may be bulk materials making up the structural elements 12, 30, or may be formed as continuous layers or coatings on these elements 12, 30 of thickness effective to prevent or suppress transfer of neutrons generated by radioactive decay events in one fuel assembly from reaching another fuel assembly. Various combinations of bulk and layered neutron moderators or absorbers are also contemplated. A given bulk material or layer may also provide both neutron moderator and neutron absorbing functionality. In one suitable configuration, a boron-impregnated neutron absorber material is interposed between neutron moderator layers of successive fuel assembly chambers 14 for criticality control. By use of suitably designed neutron moderator and/or absorber layers or elements, different fuel assembly types and varying fuel enrichments can be accommodated, including $^{235}U$ enrichment levels above 5% (the current upper limit for similar containers).

Although not illustrated, it will be appreciated that the end-caps 16, 18 can also be constructed with elastomeric material and/or neutron moderating and/or absorbing material. As previously mentioned, the lower end-cap 16 may include additional cushioning elastomeric material so as to support the fuel assembly 14 when the shipping container 10 is loaded and in the upright (vertical) position.

With particular reference to FIG. 5, after end-loading of the shipping container 10 the top end-cap 18 is replaced and secured onto the upper end of the shell 12 and the shipping container 10 is placed into its horizontal position (shown in FIG. 5) for shipping. The shell 12 and end-caps 16, 18 of the shipping container 10 are constructed to comply with mechanical stress tests in conformance with applicable nuclear regulatory rules. For example, in the United States the NRC requires that the shipping container 10 withstand specified "drop tests" in various orientations. In the illustrative shipping container 10, the illustrative end-caps 16, 18 have impact energy-absorbing conical shapes that are designed to crumple to absorb an impact in order to protect the shipping container contents. Other shapes for the end-caps can be employed (cf. FIGS. 7 and 8 which employ flat end-caps, of which only the flat top end-cap 18' is visible in FIGS. 7 and 8).

Figure 6:
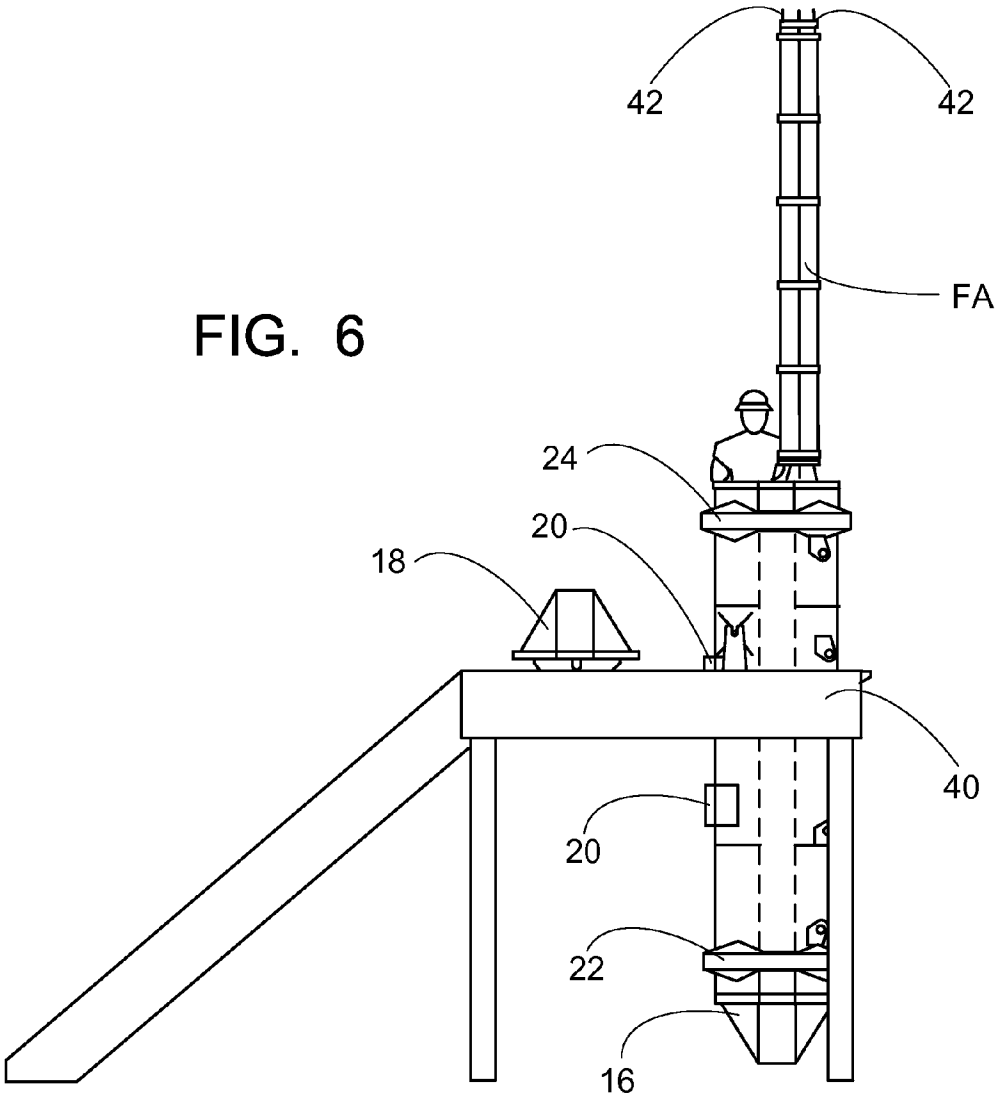
FIG. 6 illustrates a side view of the shipping container of FIGS. 1-5 mounted vertically in a loading stand with the top end cap removed and with a fuel assembly being loaded into (or unloaded from) a fuel assembly compartment.

With reference to FIG. 6, a side view is shown of the shipping container 10 secured in a loading stand 40 with an illustrative fuel assembly FA being loaded into (or unloaded from) one of the fuel assembly chambers. The upper end-cap 18 is shown off to the side on the loading stand 40. The weight of the shipping container 10 in its vertical or upright position is suitably supported in the loading stand 40 by a collar or other fastening to the loading stand 40, or by the lower end-cap 16, or by a combination of such mechanisms. The loading stand 40 provides lateral support to ensure the shipping container 10 does not move laterally during loading or unloading. Although not shown in FIG. 6, it is to be appreciated that the fuel assembly FA is loaded or unloaded using a crane or other suitable lifting apparatus engaging and lifting the fuel assembly FA. For example, Walton et al., U.S. Pub. No. 2013/0044850 A1 published Feb. 21, 2013 and incorporated herein by reference in its entirety discloses a lifting tool for a crane designed to engage mating features 42 at the top end of the fuel assembly FA to enable the crane to lift the fuel assembly for vertical loading into (and unloading from) a nuclear reactor, and such a tool is readily employed for top-loading or unloading the fuel assembly FA into or out of the shipping container 10. This is merely an illustrative example, and other fuel handling apparatus designed for top-loading and unloading fuel into and out of a nuclear reactor can readily be applied in loading or unloading the shipping container 10. As seen in FIG. 6, the fuel assembly FA comprises an array of parallel fuel rods, and during the loading these fuel rods are aligned parallel with the tube or cylinder axis of the tubular or cylindrical shell 12 so that the fuel assembly FA can be top loaded into the fuel assembly chamber. In a typical configuration, each fuel rod comprises a hollow cladding inside of which are disposed $^{235}U$ enriched fuel pellets (details not shown). The $^{235}U$ enrichment of the fuel pellets is typically less than 5% for commercial nuclear power reactor fuel.

In some contemplated embodiments, two or more different divider components may be provided which fit into the shell 12, and the shipping container 10 may be reconfigured to ship different fuel assemblies of numbers, sizes, or cross-sectional shapes by inserting the appropriate divider component into the shell 12 (or, for shipping a single large fuel assembly, not inserting any of the available divider components). Typically, the axial length of the tubular or cylindrical shell 12 (that is, its length along the tube or cylinder axis) is chosen to provide the fuel assembly chambers 14 sufficient length to accommodate the fuel assemblies FA, and optionally tensioners can be employed in one or both end-caps 16, 18 to suppress axial load shifting. It is also contemplated to provide removable spacers and/or tensioners at the top and/or bottom of a fuel assembly chamber 14 in order to accommodate fuel assemblies of different lengths (i.e. different vertical heights).

Advantageously, no clamping devices are required to restrain the fuel assembly laterally in the disclosed shipping container designs. The lack of fuel assembly clamping devices or doors to restrain the fuel assemblies provides a number of possible advantages, including, but not limited to, eliminating the possibility of loose parts such as bolts, screws, nuts, washers, and metal shavings from the movement of the clamps during removal and installation, that can become trapped in the fuel assembly and cause fuel rod failure due to fretting. Furthermore, the lack of moving parts such as clamps and doors reduces the time required to load and unload the fuel assemblies into and from the shipping container. The disclosed shipping containers are also top-loaded, which allows the shipping container to be positioned vertically without the use of a mechanical up-ender and the container top may be removed in the vertical position, thus saving time and floor space.

The disclosed shipping containers are also easily sealed. If the shell 12 is a single-piece tubular or cylindrical element, then the only sealing surfaces are at lower and upper end-caps 16, 18; and of these, only the upper end-cap 18 is removed for loading and unloading fuel assemblies. This limited length of sealing surface reduces the likelihood of inadequate sealing.

The disclosed shipping containers are top-loaded and top-unloaded, which has advantages including allowing the loading and unloading to be performed using a crane to manipulate the fuel assemblies using crane lift and transfer operations similar to those used in loading and unloading fuel from the nuclear reactor core. However, the fuel transport process includes the operations at the fuel source location of moving the loaded shipping container from the vertical position to the horizontal position for transport; and then at the nuclear reactor site "up-ending" the loaded shipping container from the horizontal position to the vertical position for unloading. Conventionally, these operations employ dedicated equipment, referred to in the art as an "up-ender". Existing up-enders are typically complex dedicated pieces of equipment that have numerous components and that occupy substantial storage space when not in use. An up-ender must be provided at both the fuel source location and at the nuclear reactor site (or, alternatively, a single up-ender can be transported between these two sites, for example integrated into the bed of the transport truck).

Figure 8:
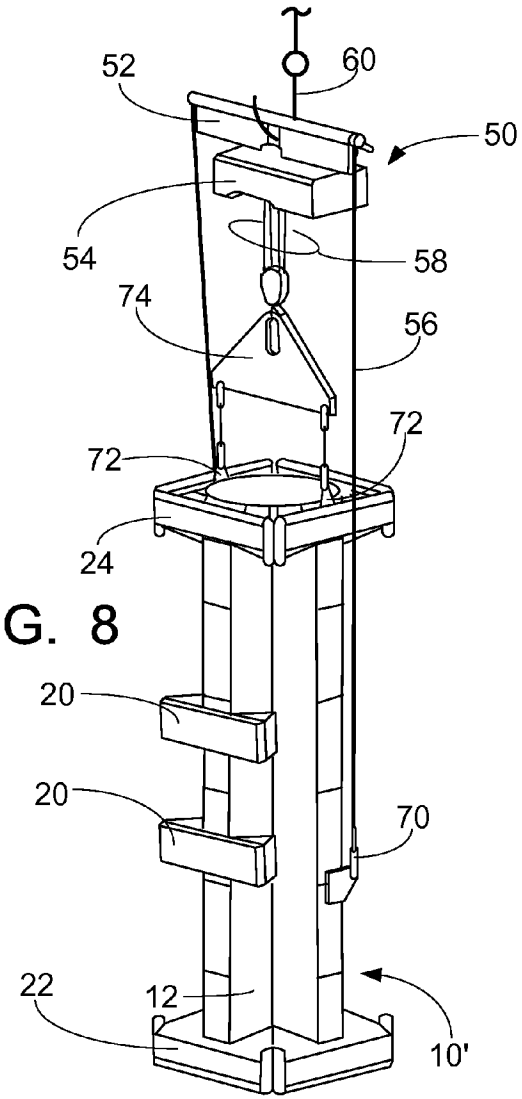
FIGS. 7 and 8 illustrate perspective views of a winch-based up-ender operating to move the shipping container of FIGS. 1-4 from the horizontal position (FIG. 7) to the vertical position (FIG. 8).
Figure 7:
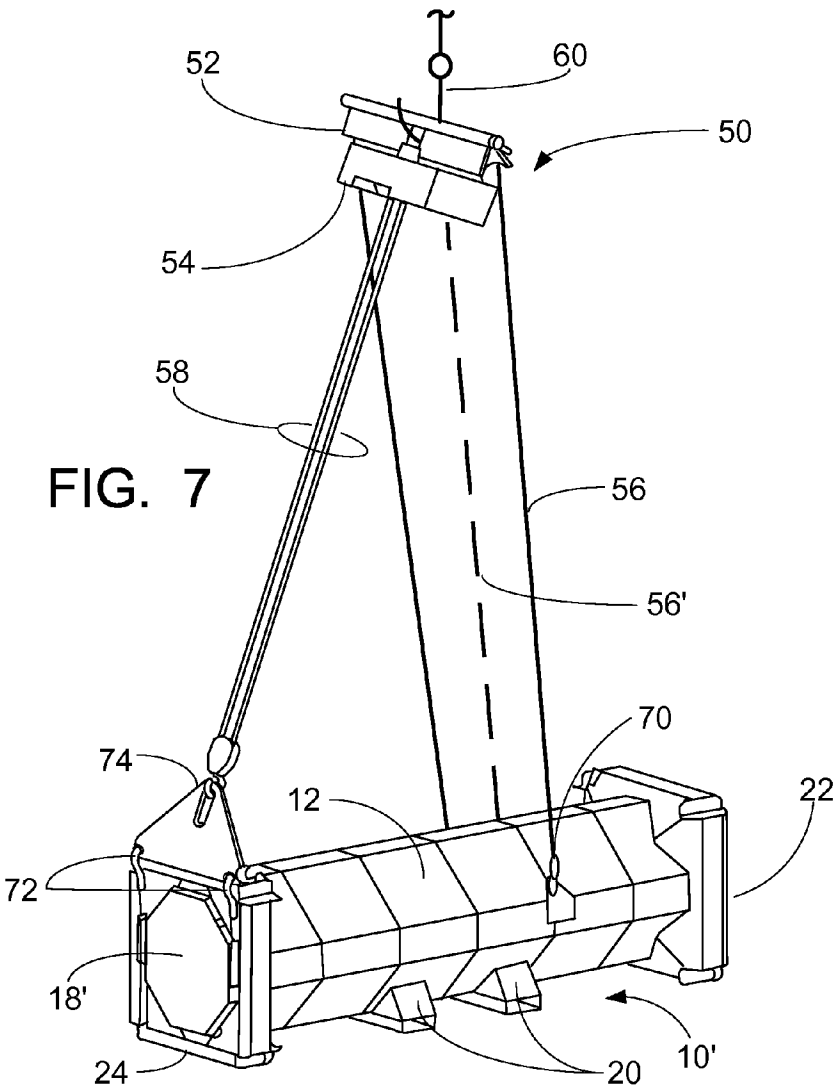

With reference to FIGS. 7 and 8, an improved up-ender 50 is disclosed, which is constructed as a tool for a crane or hoist. The tool includes a lifting anchor element, e.g. an illustrative lifting beam 52, and an auxiliary winch 54. Rigging lines 56 have upper ends secured to the lifting anchor element 52 and extend generally downward from the lifting anchor element 52. Winch cabling 58 extends generally downward from the auxiliary winch 54. A hook 60 or other connection to a crane or hoist (not shown) connects with the lifting anchor element 52 so that the crane or hoist can raise or lower the lifting anchor element 52. The lifting anchor element 52 can take other shapes and forms besides the illustrative beam configuration.

The winch 54 may be separate from the lifting anchor element 52, as illustrated, or may be integrated with (e.g. housed inside) the lifting anchor element. If the winch 54 is separate from the lifting anchor element 52 (as shown), then the winch 54 is connected with the lifting anchor element 52 such that operating the crane or hoist to raise (lower) the lifting anchor element 52 also raises (lowers) the winch 54 together with the lifting anchor element 52. The winch 54 has a motorized spool assembly or other mechanism (not shown) by which the length of the winch cabling 58 extending downward from the winch 54 can be lengthened or shortened. In such embodiments, control of the winch 54 can be via a wireless communication link, or via a signal cable extending from the winch 54. Alternatively, a motorized spool assembly or other mechanism may be integrated with the crane or hoist and the winch cabling 58 passed through the auxiliary winch 54 to the mechanism in the crane or hoist in order to lengthen or shorten the winch cabling. In contrast to the winch cabling 58, the illustrative rigging lines 56 are of fixed length (although some motorized mechanism for length adjustment of the rigging lines is also contemplated).

The up-ender 50 is shown engaging a shipping container 10' oriented in the horizontal position in FIG. 7, and engaging the same shipping container 10' oriented in the vertical position in FIG. 8. The illustrative shipping container 10' is similar to the shipping container 10 described with reference to FIGS. 1-6, but the conical end-caps 16, 18 of the shipping container 10 are replaced by flat end-caps, of which only the flat top end-cap 18' is visible in FIGS. 7 and 8. The shipping container 10' of FIGS. 7 and 8 also differs from the shipping container 10 of FIGS. 1-6 in that the shipping container 10' includes: at least one lifting connection 70 connected at some point along the shipping container 10' (in the illustrative embodiment, two lateral lifting features 70 at opposite sides of the shipping container 10' near the center of the shipping container 10') and to which the lower ends of the rigging lines 56 connect; and at least one top connection 72 at the top of the shipping container 10' to which the winch cabling 58 connects. In the illustrative example, the winch cabling 58 connects with two top connections 72 via a fixture 74; however, a direct connection is also contemplated. The top connection can be made either to the top of the shell 12 (as shown) or, if the top end-cap is sufficiently well-secured to the shell 12, can be made to the top end-cap.

Operation of the illustrative up-ender 50 is as follows. The up-ending process (that is, transition from the horizontal position shown in FIG. 7 to the vertical position shown in FIG. 8) starts with connecting the lower ends of the rigging lines 56 to the lateral lifting features 70 of the shipping container 10', and connecting the lower end of the winch cabling 58 to the top connection 72 (optionally via the fixture 74) of the shipping container 10'. The crane or hoist is operated to raise the lifting anchor element 52 to a height at which the rigging lines 56 are drawn taut without actually lifting the shipping container 10'. The winch 54 is then operated to draw the winch cabling 58 taut, again without actually lifting the shipping container 10'.

Thereafter, the crane or hoist operates to continue raising the lifting anchor element 52 and the integral or connected winch 54. Since the rigging lines 56 and winch cabling 58 are both taut at the start of this lifting operation, the result is to lift the shipping container 10' upward while keeping the shipping container 10' in its horizontal position. This lifting is continued until the raised shipping container 10' has sufficient ground clearance to be rotated about the lateral lifting features 70 into the vertical position about the without hitting the ground. At this point, the lifting operation is terminated and the winch 54 is operated to draw in (i.e. shorten) the winch cabling 58. This operates to rotate the shipping container 10' about the lateral lifting features 70 by raising the upper end of the shipping container 10'. The winch is thus operated until the vertical position shown in FIG. 8 is achieved.

Transitioning from the vertical position (FIG. 8) to the horizontal position (FIG. 7) is as follows. The process again starts with connecting the lower ends of the rigging lines 56 to the lateral lifting features 70 of the shipping container 10', and connecting the lower end of the winch cabling 58 to the top connection 72 (optionally via the fixture 74) of the shipping container 10'. The crane or hoist is operated to raise the lifting anchor element 52 to a height at which the rigging lines 56 are drawn taut without actually lifting the shipping container 10'. The winch 54 is then operated to draw the winch cabling 58 taut, again without actually lifting the shipping container 10'. Thereafter, the crane or hoist operates to continue raising the lifting anchor element 52 and the integral or connected winch 54. Since the rigging lines 56 and winch cabling 58 are both taut at the start of this lifting operation, the result is to lift the shipping container 10' upward while keeping the shipping container 10' in its vertical position. In this case, because the shipping container 10' has its lowest extent when it is in the vertical position, the lifting can be brief, i.e. just enough to lift the vertically oriented shipping container 10' off the ground. At this point, the lifting operation is terminated and the winch 54 is operated to let out (i.e. lengthen) the winch cabling 58. This operates to rotate the shipping container 10' about the lateral lifting features 70 by lowering the upper end of the shipping container 10'. The winch is thus operated until the horizontal position shown in FIG. 7 is achieved.

In the illustrative embodiment of FIGS. 7 and 8, it will be noted that the lateral lifting features 70 are not at the center of the length of the shipping container 10', but rather are slightly closer to the lower end versus the upper end. As seen in FIG. 7, this has the effect that the rigging lines 56, when drawn taut, are not precisely vertical but rather are angled toward the lower end of the shipping container 10' at a small angle off vertical. This has the advantage of reducing the winch force needed to initiate the rotation of the horizontal shipping container 10' toward the vertical position. While this provides some mechanical benefit, the up-ender would also work with the lateral lifting features at the center of the length of the shipping container, or even with the lateral lifting features shifted slightly toward the upper end of the shipping container.

In an alternative embodiment for reducing the force needed to rotate the shipping container, the lifting anchor element 52 can be replaced by a second winch so that the rigging lines 56 become secondary winch cabling whose length can be adjusted. In this variant embodiment, going from the horizontal to the vertical position can be achieved by first letting out some line on the secondary winch cabling so as to lower the bottom end of the shipping container, and then drawing in the (primary) winch cabling 58 to raise the top end of the shipping container. In this approach, however, care must be taken to ensure the crane or hoist is lifted high enough prior to the rotation operation to provide sufficient ground clearance to accommodate the lowering of the bottom end of the shipping container during the rotation.

The lateral lifting features 70 can have the form of an eyehole, as shown, or can have a more complex configuration that promotes easy rotation of the shipping container about the lateral lifting features, for example by including a swivel element. The illustrative embodiments include two lateral lifting features 70 connected at opposite sides of the shipping container 10'. This arrangement advantageously provides a balanced pivot axis for rotating the shipping container 10' between vertical and horizontal. More generally, however, at least one lifting connection 70 is connected at some point along the shipping container 10'. For example, a single rigging line 56' (indicated by a dashed line only in FIG. 7) could pivotally connect with an upper surface of the (horizontally oriented) shipping container. In this case, it would not be possible to rotate the shipping container into a precisely vertical position since the single rigging line 56' would impinge on the shipping container; however, it would be possible to achieve a nearly vertical orientation which might, for example, be sufficient to then lower the shipping container into the loading stand 40 of FIG. 6.

The winch 54 can be located anywhere along the winch cabling 58, and in some embodiments it is contemplated to integrate the winch into the fixture 74 proximate to the upper end of the shipping container. Note that in this case, the winch is connected with the lifting anchor element when the winch cabling is taut such that operating the crane or hoist to raise (lower) the lifting anchor element also raises (lowers) the winch together with the lifting anchor element.

An advantage of the lift-based up-ender 50 is that the shipping container (in either its horizontal or vertical position) can be moved laterally using the crane or hoist. This can reduce operations. For example, to place a newly shipped container into the loading stand 40 of FIG. 6, a conventional process would employ a dedicated up-ender apparatus to up-end the shipping container into the vertical position, followed by connection of a separate crane to the vertically oriented shipping container to lift and laterally move the vertical shipping container. By contrast, the lift-based up-ender 50 can lift the horizontal shipping container, rotate it to vertical, and then move it laterally without placing it back onto the ground. Alternatively, the shipping container could be moved laterally into a desired position and then rotated to the vertical if advantageous to do so (e.g., based on available space clearances for the lateral transport).

While illustrated operating on the shipping container 10', more generally the disclosed up-ender 50 can be used with substantially any type of unirradiated fuel shipping container that is to be rotated between horizontal and vertical positions, so long as the lifting connections 70 and top connection 72 can be made to the shipping container. Thus, the lift-based up-ender 50 can also be used with a clamshell-type shipping container or other type of unirradiated fuel shipping container.

The present disclosure has been described with reference to exemplary embodiments. Obviously, modifications and alterations will occur to others upon reading and understanding the preceding detailed description. It is intended that the present disclosure be construed as including all such modifications and alterations insofar as they come within the scope of the appended claims or the equivalents thereof.

I claim:

1. A method performed on a shipping container having a defined top and bottom and including a lifting connection feature disposed on the shipping container between the top and bottom of the shipping container and a top connection feature disposed at the top of the shipping container, the method using an up-ender comprising a lifting anchor element with a rigging line extending downward and connecting with the lifting connection feature of the shipping container and a winch connected with the lifting anchor element and including winch cabling extending downward and connecting with the top connection feature of the shipping container, the method comprising:

(1) raising the lifting anchor element to draw the rigging line taut and operating the winch to draw the winch cabling taut;

(2) further raising the lifting anchor element to lift the lifting anchor element and the winch connected with the lifting anchor element upward whereby the shipping container is lifted off the ground by the taut rigging line and the taut winch cabling; and (3) reorienting the shipping container by one of (i) operating the winch to shorten the winch cabling so as to rotate the shipping container about the lifting connection feature from a horizontal orientation to a vertical orientation and (ii) operating the winch to lengthen the winch cabling so as to rotate the shipping container about the lifting connection feature from a vertical orientation to a horizontal orientation.

2. The method of claim 1 wherein the reorienting operation (3) comprises (ii) operating the winch to lengthen the winch cabling so as to rotate the shipping container about the lifting connection feature from a vertical orientation to a horizontal orientation, and the method further comprises:

prior to performing the operations (1), (2), and (3), loading an unirradiated nuclear fuel assembly comprising $^{235}U$ enriched fuel into the shipping container, whereby the operations (1), (2), and (3) operate on the shipping container containing the loaded unirradiated nuclear fuel assembly.

3. The method of claim 2 wherein the loading comprises loading the unirradiated nuclear fuel assembly into the shipping container with the shipping container in the vertical orientation.

4. The method of claim 2 wherein the loading comprises top-loading the unirradiated nuclear fuel assembly into an opening at the top of the shipping container with the shipping container in the vertical orientation.

5. The method of claim 1 wherein the reorienting operation (3) comprises (i) operating the winch to shorten the winch cabling so as to rotate the shipping container about the lifting connection feature from a horizontal orientation to a vertical orientation.

6. The method of claim 5 wherein the method further comprises:

after performing the operations (1), (2), and (3), loading an unirradiated nuclear fuel assembly comprising $^{235}U$ enriched fuel into the shipping container; and after the loading operation, operating the winch to lengthen the winch cabling so as to rotate the shipping container with the loaded unirradiated nuclear fuel assembly about the lifting connection feature from a vertical orientation to a horizontal orientation.

7. The method of claim 6 wherein the loading operation comprises top-loading the unirradiated nuclear fuel assembly into an opening at the top of the shipping container.

8. An apparatus comprising:

a shipping container configured to contain at least one unirradiated nuclear fuel assembly, the shipping container having a defined top and bottom and including:

a lifting connection feature disposed on the shipping container between the top and bottom of the shipping container, and a top connection feature disposed at the top of the shipping container; and an up-ender comprising:

a lifting anchor element configured to be raised or lowered by a crane or hoist and including at least one rigging line extending downward to connect with the lifting connection feature of the shipping container, and a winch including winch cabling extending downward to connect with the top connection feature of the shipping container wherein the length of the winch cabling is adjustable by operation of the winch, wherein the winch is configured to move with the lifting anchor element as the lifting anchor element is raised or lowered by a crane or hoist at least when the winch cabling is drawn taut.

9. The apparatus of claim 8 wherein the winch is connected with the lifting anchor element.

10. The apparatus of claim 8 wherein the lifting connection feature comprises two lifting connection features disposed opposite sides of the shipping container and the at least one rigging line comprises two rigging lines connected with the two respective lifting connection features.

11. The apparatus of claim 10 wherein the lifting anchor element comprises a lifting beam with a rigging line extending down from each end of the lifting beam.

12. The apparatus of claim 10 wherein the lifting connection features comprise eyeholes or swivel elements.

13. The apparatus of claim 8 wherein the lifting connection feature is disposed on the shipping container about midway between the top and bottom of the shipping container.

14. The apparatus of claim 13 wherein the lifting connection feature is disposed on the shipping container relatively closer to the bottom of the shipping container than to the top of the shipping container.

15. The apparatus of claim 8 wherein the shipping container and the up-ender are configured to perform the operations of:

(1) suspending the shipping container in a horizontal position from the up-ender by the lifting connection feature via the rigging line and by the top connection feature by the winch cabling, and (2) upending the shipping container from the horizontal position to a vertical position by operating the winch to shorten the winch cabling such that the shipping container rotates about the lifting connection feature.

16. The apparatus of claim 15 further comprising at least one unirradiated nuclear fuel assembly comprising $^{235}U$ enriched fuel disposed in the shipping container.

17. The apparatus of claim 8 further comprising at least one unirradiated nuclear fuel assembly comprising $^{235}U$ enriched fuel disposed in the shipping container.

18. A method comprising:

lifting a shipping container off the ground by operating a crane to raise a lifting tool comprising a winch, the lifting tool being connected with the shipping container by (i) a rigging line connecting with the shipping container at a lifting point located on the shipping container between the top and bottom of the shipping container and (ii) winch cabling connecting with the shipping container at the top of the shipping container; and reorienting the shipping container by operating the winch to adjust the length of the winch cabling so as to rotate the shipping container about the lifting point.

19. The method of claim 18 wherein the reorienting comprises operating the winch to shorten the winch cabling by an amount effective to rotate the shipping container about the lifting point from a horizontal orientation to a vertical orientation.

20. The method of claim 19 wherein the lifting is performed with the shipping container in the horizontal orientation.

21. The method of claim 19 wherein the shipping container contains an unirradiated nuclear fuel assembly comprising $^{235}U$ enriched fuel, and the method further comprises, after reorienting the shipping container from the horizontal orientation to the vertical orientation, unloading the unirradiated nuclear fuel assembly from the vertically oriented shipping container.

22. The method of claim 18 wherein the reorienting comprises operating the winch to lengthen the winch cabling by an amount effective to rotate the shipping container about the lifting point from a vertical orientation to a horizontal orientation.

23. The method of claim 22 wherein the lifting is performed with the shipping container in the vertical orientation.

24. The method of claim 22 further comprising:

prior to performing the lifting and reorienting operations, loading an unirradiated nuclear fuel assembly comprising $^{235}U$ enriched fuel into the shipping container, whereby the lifting and reorienting operations are performed on the shipping container containing the unirradiated nuclear fuel assembly.

25. The method of claim 18 further comprising:

loading an unirradiated nuclear fuel assembly comprising $^{235}U$ enriched fuel into the shipping container.

* * * * *